US010343264B2

(12) United States Patent
Winefordner et al.

(10) Patent No.: US 10,343,264 B2
(45) Date of Patent: Jul. 9, 2019

(54) ADJUSTABLE SPANNER

(71) Applicant: BROOKS ENGLAND LIMITED, Birmingham (GB)

(72) Inventors: Carl Winefordner, Laguna Beach, CA (US); Frank Hermansen, Laguna Beach, CA (US)

(73) Assignee: BROOKS ENGLAND LIMITED, Birmingham (GB)

( * ) Notice: Subject to any disclaimer, the term of this patent is extended or adjusted under 35 U.S.C. 154(b) by 40 days.

(21) Appl. No.: 14/903,223

(22) PCT Filed: Jul. 10, 2013

(86) PCT No.: PCT/IB2013/055679
§ 371 (c)(1),
(2) Date: Jan. 6, 2016

(87) PCT Pub. No.: WO2015/004504
PCT Pub. Date: Jan. 15, 2015

(65) Prior Publication Data

US 2016/0158922 A1 Jun. 9, 2016

(51) Int. Cl.

| | |
|---|---|
| ***B25B 13/22*** | (2006.01) |
| ***B25B 27/00*** | (2006.01) |
| ***B25B 13/12*** | (2006.01) |

(52) U.S. Cl.
CPC ..... *B25B 13/22* (2013.01); *B25B 13/12* (2013.01); *B25B 27/0071* (2013.01)

(58) Field of Classification Search
CPC ..... B25B 13/00; B25B 13/02; B25B 13/08; B25B 13/12; B25B 13/22; B25B 13/34; B25B 13/42; B25B 13/5058; B25B 27/0071
USPC ... 81/129, 131, 132, 150, 163, 176.1, 176.3, 81/177.6, 58.2, 77, DIG. 7
See application file for complete search history.

(56) References Cited

U.S. PATENT DOCUMENTS

| | | | | |
|---|---|---|---|---|
| 2,165 A * | 7/1841 | Brett | ..... | B25B 13/12 81/148 |
| 24,190 A * | 5/1859 | Brewster | ..... | B25B 13/12 81/152 |
| 59,242 A * | 10/1866 | Love | ..... | B25B 13/12 81/77 |

(Continued)

FOREIGN PATENT DOCUMENTS

| | | |
|---|---|---|
| BE | 340243 | 2/1927 |
| DE | 826127 | 12/1951 |

(Continued)

*Primary Examiner* — Joseph J Hail
*Assistant Examiner* — Arman Milanian
(74) *Attorney, Agent, or Firm* — Tutunjian & Bitetto, P.C.

(57) ABSTRACT

An adjustable spanner, including a stationary jaw and a movable jaw, suitable to be coupled to the stationary jaw in a plurality of different positions in order to engage objects of different sizes, and adjustable coupling means provided between the stationary jaw and the movable jaw. The adjustable coupling means include a substantially flat base, which is fixed to said stationary jaw and which includes a folded portion laterally embracing the movable jaw, in such a way that the stationary jaw and the movable jaw lay substantially on the same plane.

9 Claims, 8 Drawing Sheets

(56) References Cited

U.S. PATENT DOCUMENTS 143,367 A * 9/1873 McMaster ..... B25B 5/04 81/131
164,453 A * 6/1875 Heysinger ..... B25B 13/12 81/132
521,130 A * 6/1894 Van De Water ..... B25B 7/10 81/131
559,901 A * 5/1896 Lovell ..... B25B 13/12 81/163
583,870 A * 6/1897 Roberts ..... B25B 13/12 81/131
585,412 A * 6/1897 Thomas ..... B25B 5/04 81/131
717,390 A * 12/1902 Gray ..... B25B 13/12 81/171
718,501 A * 1/1903 Morgan ..... B25B 5/04 81/131
844,905 A * 2/1907 Young ..... B25B 5/04 81/131
865,766 A * 9/1907 Davis ..... B25B 13/12 81/146
904,008 A * 11/1908 O'Neill ..... B25B 5/04 81/131
1,027,830 A * 5/1912 Foster ..... B25B 13/22 81/131
1,191,596 A * 7/1916 Hindman ..... B25B 13/12 81/132
1,321,187 A * 11/1919 Brower ..... B25B 13/12 81/77
1,367,222 A * 2/1921 Wilson ..... B25B 13/22 81/147
1,386,325 A * 8/1921 Fisher ..... B25B 13/22 81/131
1,421,287 A * 6/1922 Moore ..... B25B 13/12 7/142
1,468,834 A * 9/1923 Rhodes ..... B25B 13/20 81/150
1,556,523 A * 10/1925 Hughes ..... B25B 13/12 81/129
1,563,942 A * 12/1925 Acord ..... B25B 7/10 81/110
1,633,077 A * 6/1927 Dreesen ..... B25B 13/12 81/132
2,240,370 A * 4/1941 Hufschmid ..... B25B 7/02 7/127
2,699,699 A * 1/1955 Christopherson ..... B25B 13/12 81/160
3,376,766 A * 4/1968 Vienat ..... B25B 13/12 81/125.1
5,345,636 A * 9/1994 Lamons ..... B25B 13/10 7/107
6,257,100 B1 * 7/2001 Tai ..... B25B 13/12 7/139

FOREIGN PATENT DOCUMENTS

DE 29605486 5/1996
FR 325263 4/1903
FR 548143 1/1923
FR 2403171 4/1979
FR 2403171 A1 * 4/1979 ..... B25B 13/12
GB 256668 8/1926

* cited by examiner

ADJUSTABLE SPANNER

TECHNICAL FIELD OF THE INVENTION

The present invention relates to an adjustable spanner.

STATE OF THE ART

Spanners are known which allow the operator to adjust the distance between the two jaws, in order to fit the specific employment of the tool.

In some specific applications, for example bicycle applications, an important feature of the spanner is its overall thickness: for example, this feature is crucial when adjusting the nuts of bicycle hubs, which are commonly very close to each other.

Such operation can be comfortably performed when using fixed spanners, i.e. not adjustable, which can be typically 2 to 2.3 mm thick.

Adjustable spanners are very convenient in bicycle applications, because they can be easily carried by the user when riding the bicycle, and they can fit many different employments during the ride.

It has been observed that adjustable spanners of the known type have normally an overall thickness which is too large for some applications, for example adjusting the nuts of bicycle hubs, or headsets of the kind using a cup and cone configuration.

Such operations are therefore not so comfortable to perform with known kinds of adjustable spanners, since they comprise adjusting means, of various kinds, which necessarily increase the overall thickness of the tool.

Another important requirement of spanners used in bicycle applications, beside overall encumbrance, is the weight of the tool, which should be, obviously, the lowest possible in order to facilitate the carriage by the user.

One would need to carry many fixed spanners in order to fit all the sizes necessary on a bicycle, and in total this would be heavy and bulky to carry.

Adjustable spanners of the known kind are usually heavier than each fixed spanner since they comprise adjustment means, therefore they are not so comfortable to carry.

SUMMARY OF THE INVENTION

The technical aim of the present invention is therefore to improve the state of the art.

Within such technical aim, a purpose of the present invention is developing an adjustable spanner having an overall thickness lower than that of the adjustable spanners of the known kind.

Another purpose of the present invention is developing an adjustable spanner that weights less than the adjustable spanners of the known kind.

Still another purpose of the present invention is developing an adjustable spanner which is simple and practical to use, and simple and cheap to manufacture.

This aim and these purposes are achieved by the adjustable spanner according to the present specification.

The adjustable spanner according to the invention comprises a stationary jaw and a movable jaw, suitable to be coupled to the stationary jaw in a plurality of different positions in order to engage objects of different size, and adjustable coupling means provided between the stationary jaw and the movable jaw.

The adjustable coupling means comprise a substantially flat base, which is fixed to the stationary jaw and which comprises a folded portion laterally embracing the movable jaw, in such a way that the stationary jaw and the movable jaw lay substantially on the same plane.

Thanks to this solution, the overall thickness of the adjustable spanner is significantly lower than that of the adjustable spanners of the known kind, since the components are arranged on just two layers.

The same can be said for the weight of the spanner according to the invention.

At the same time, the adjustable spanner is very simple and practical to use, and cheap to manufacture.

The present specification relates to preferred and advantageous embodiments of the invention.

BRIEF DESCRIPTION OF THE DRAWINGS

These and other advantages will be better understood by any man skilled in the art from the description that follows and from the attached drawings, given as a non-limiting example, in which.

DETAILED DESCRIPTION OF EMBODIMENTS OF THE INVENTION

Figure 1:
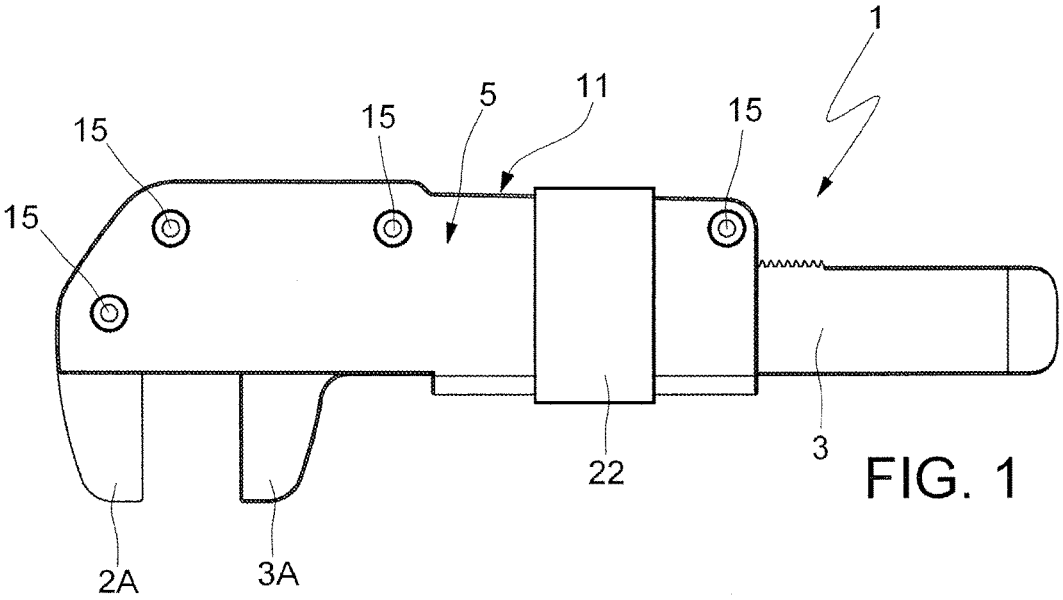
FIG. 1 is a top view of the adjustable spanner according to the invention.

With reference to FIG. 1, an adjustable spanner according to the invention is wholly indicated with 1.

As it will clearly appear hereafter, the adjustable spanner 1 according to the present invention is particularly, but not exclusively, indicated for use in many bicycle applications, but also in many other technical applications in which a simple and light adjustable spanner is required.

The adjustable spanner 1 comprises a stationary jaw 2.

The adjustable spanner 1 further comprises a movable jaw 3.

The movable jaw 3 is suitable to be coupled to the stationary jaw 2 in a plurality of different positions, in order to engage objects of different sizes.

Such objects are typically screw heads, nuts, rings, locknuts, and the like, but also many other kinds of objects without any limitation.

Figure 10:
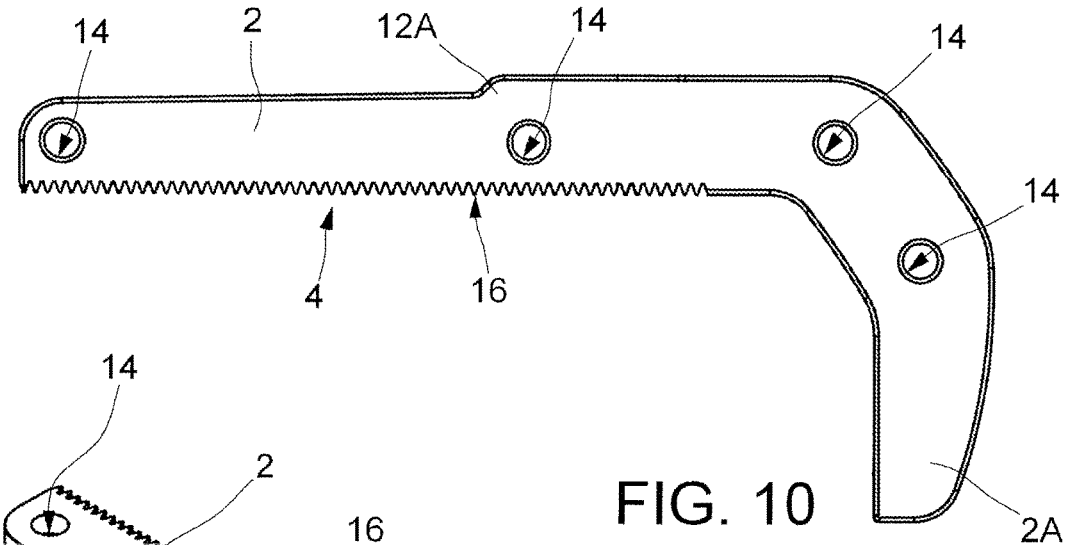
FIG. 10 is a bottom view of the stationary jaw of the spanner.
Figure 11:
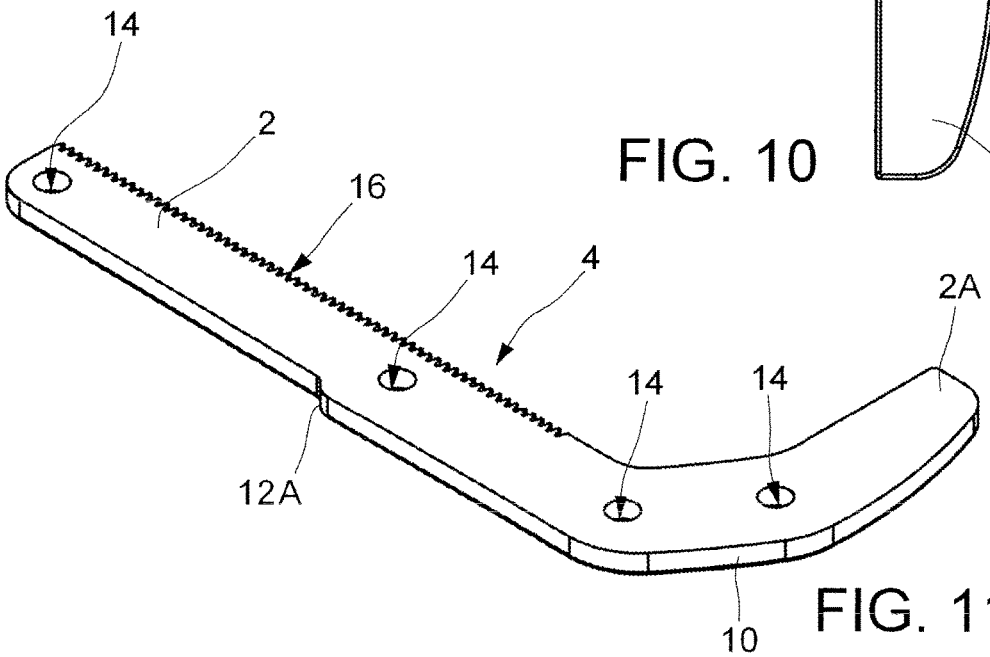
FIG. 11 is an isometric top view of the stationary jaw of the spanner.
Figure 12:
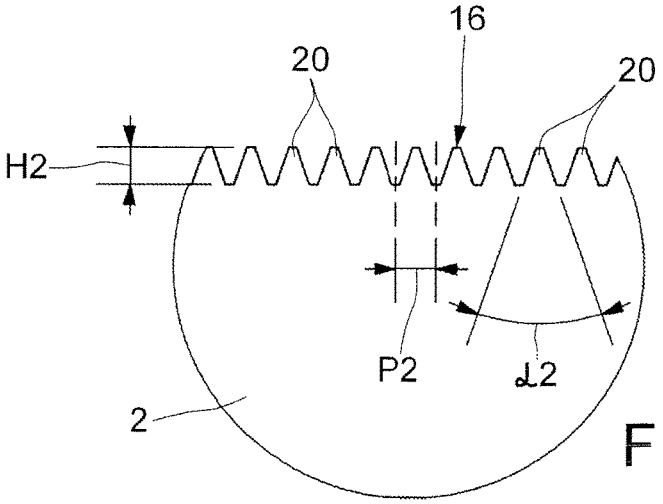
FIG. 12 is a further detail of FIG. 10.

The stationary jaw 2 is shown in detail in FIGS. 10-12.

Figure 7:
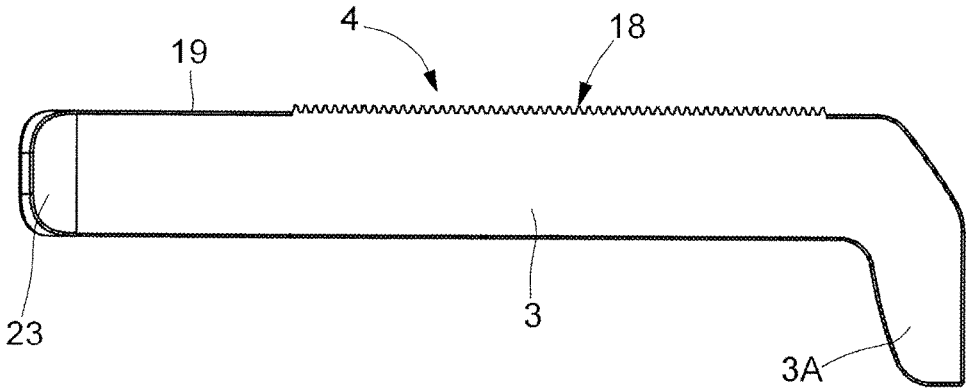
FIG. 7 is a bottom view of the movable jaw of the spanner.
Figure 8:
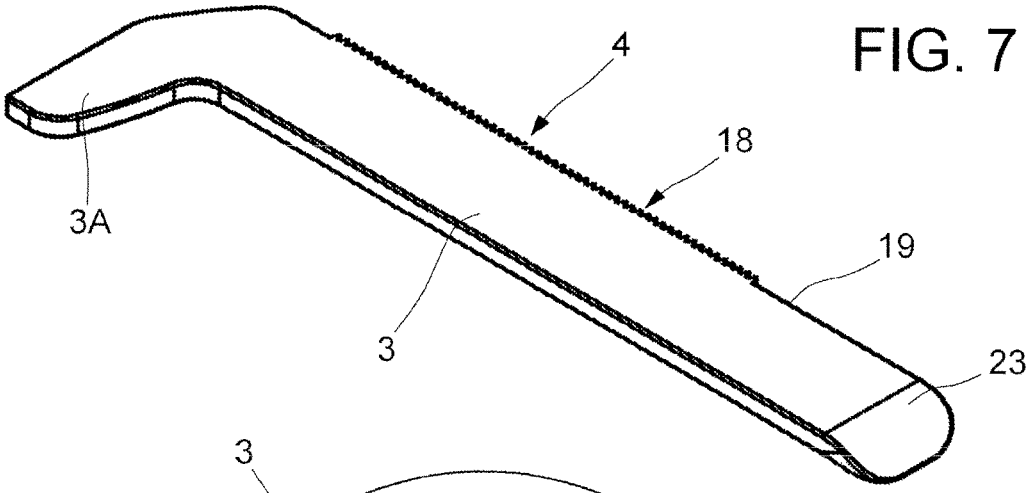
FIG. 8 is an isometric top view of the movable jaw of the spanner.
Figure 9:
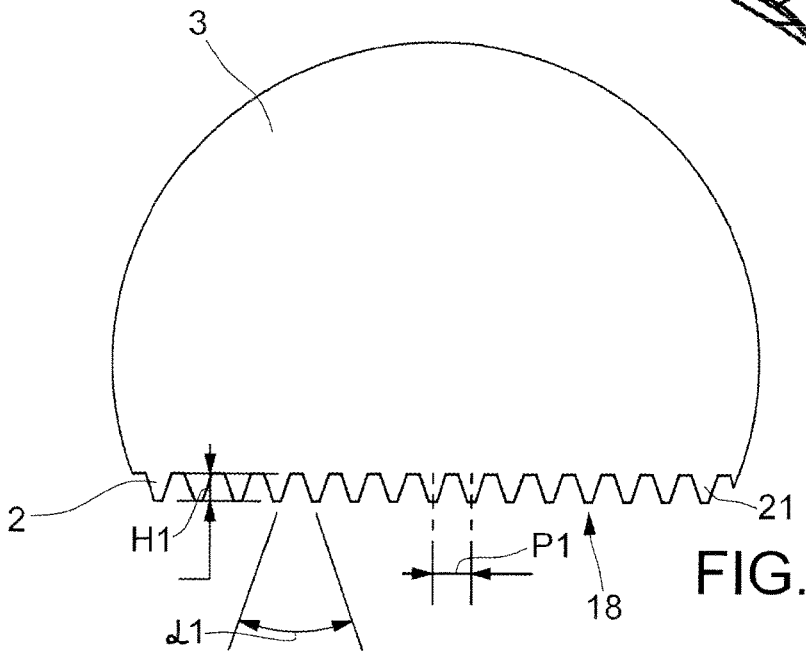
FIG. 9 is a further detail of FIG. 7.

The movable jaw 3 is shown in detail in FIGS. 7-9.

The stationary jaw 2 and the movable jaw 3 are both substantially L-shaped.

The stationary jaw 2 and the movable jaw 3 comprise respective operative end portions 2A,3A, suitable to engage objects between them.

The stationary jaw 2 and the movable jaw 3 are preferably made of metal material, for example stainless steel.

In other embodiments of the invention, the stationary and movable jaw 2,3 could be made of different materials which are suitable to satisfy the requirements of this specific application.

The adjustable spanner 1 comprises, in addition, adjustable coupling means, wholly indicated with 4, provided between the stationary jaw 2 and the movable jaw 3.

The adjustable coupling means 4 allow the user to selectively displace the movable jaw 3 with respect to the stationary jaw 2 in order to fit the spanner 1 to the object to be engaged by the same.

According to an aspect of the present invention, the adjustable coupling means 4 comprise a base 5. The base 5 is flat or substantially flat; it is shown in detail in FIGS. 13,14,15.

The base 5 is fixed to the stationary jaw 2. The base 5 is made, for example, of stainless steel, or any other material suitable for the application, for example a high-resistance polymeric material.

The base 5 comprises a folded portion 6 which embraces laterally the movable jaw 3.

Figure 5:
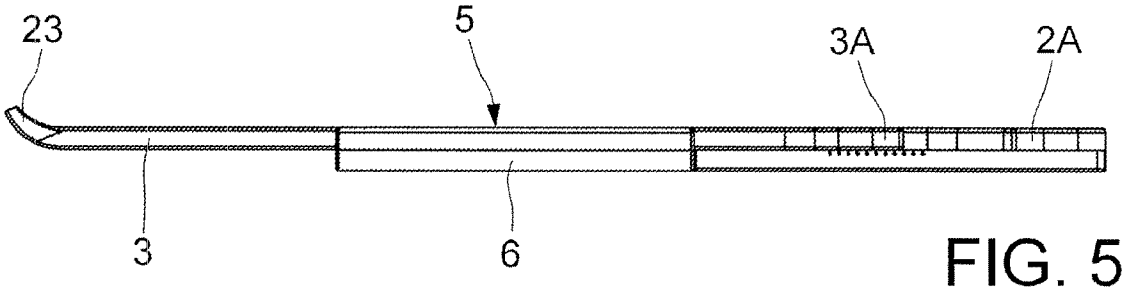
FIG. 5 is a side view of the spanner.

More in detail, the folded portion 6 embraces the movable jaw 3 in such a way that the stationary jaw 2 and the movable jaw 3 lay substantially on the same plane, as shown for example in the side view of FIG. 5.

This feature is particularly important and advantageous, because it allows to obtain a small overall thickness of the adjustable spanner 1, as it well become clear hereafter.

More in detail, the base 5 comprises a first portion 7 and a second portion 8.

The folded portion 6 of the base 5 is provided along a lateral edge of the first portion 7 of the base 5.

Figure 15:
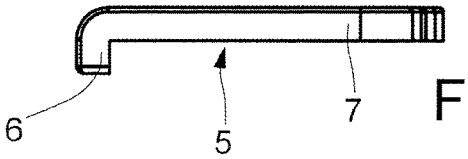
FIG. 15 is a front view of the base of the spanner.

The first portion 7 of the base 5 has a substantially L-shaped cross-section, as shown in the front view of FIG. 15.

The shorter side of the L-shaped cross-section of the first portion 7 of the base 5 corresponds to the above-cited folded portion 6.

Figure 17:
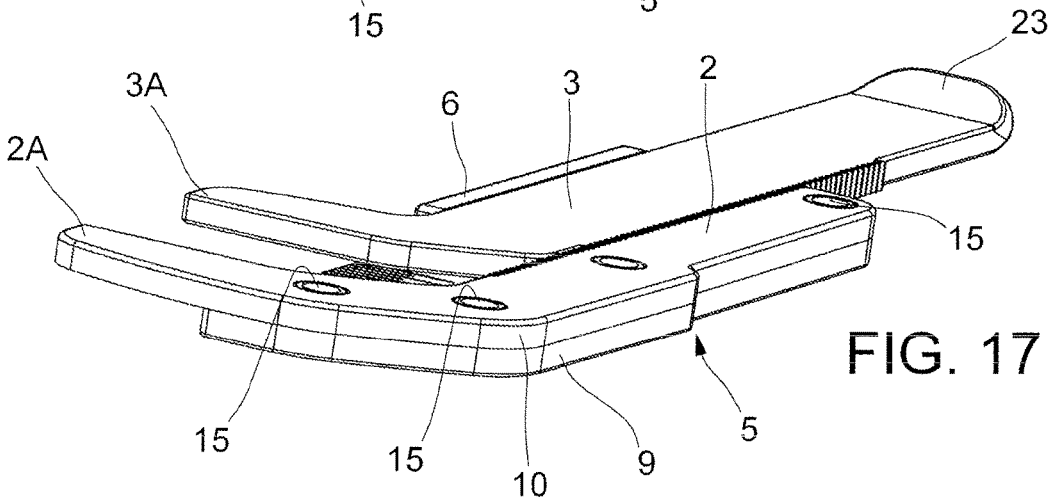
FIG. 17 is a further isometric bottom view of the spanner.

According to another aspect of the present invention, the base 5 comprises a perimetric profile 9 which mates the external edge 10 of the stationary jaw 2—as visible for example in FIG. 17—thus defining an handle portion of the spanner 1, wholly indicated with 11.

Preferably, the perimetric profile 9 of the base 5 exactly mates the external edge of the stationary jaw 2, thus obtaining a compact and clean construction.

The handle portion 11 allows the user to comfortably hold the adjustable spanner 1 when performing operations of various kinds.

The handle portion 11 corresponds, in particular, to the first portion 7 of the base 5.

Figure 13:
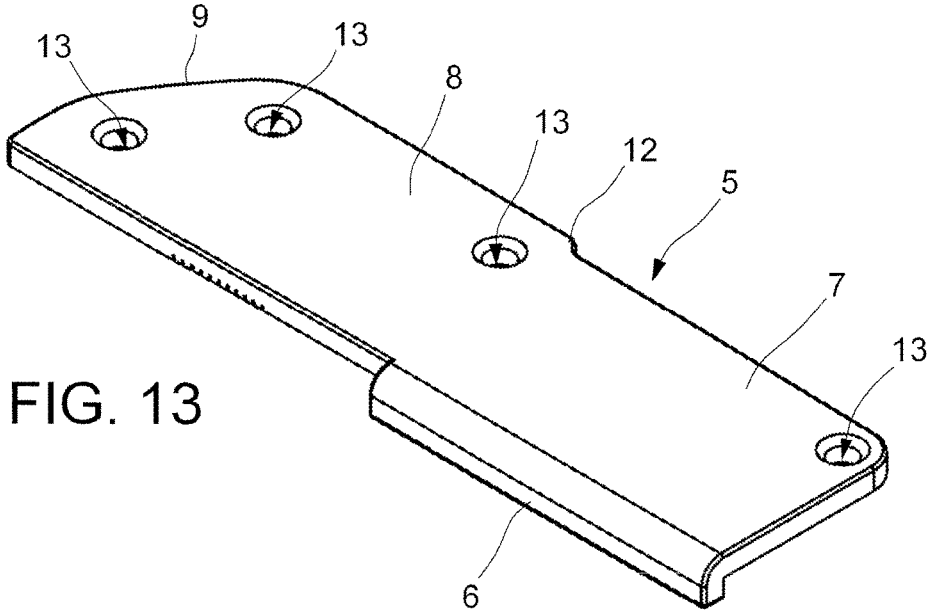
FIG. 13 is an isometric top view of the base of the spanner.
Figure 14:
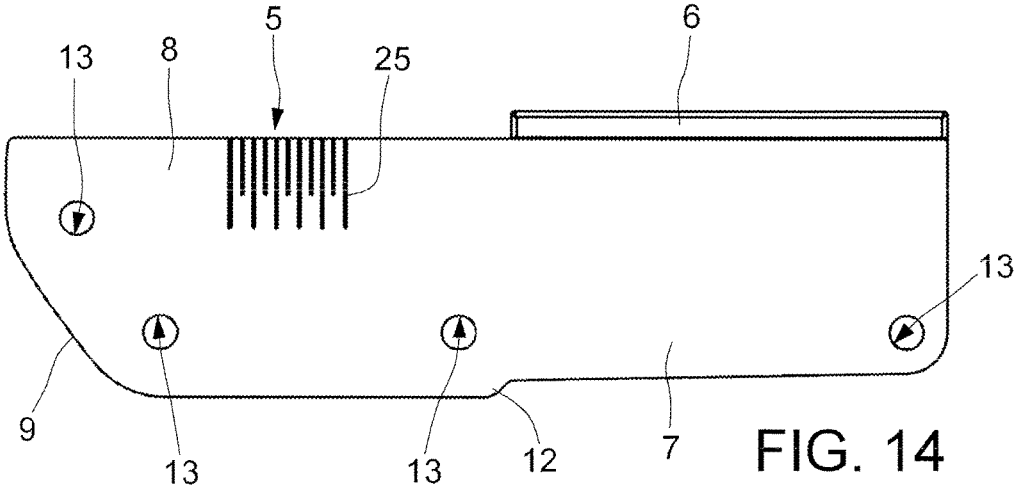
FIG. 14 is a bottom view of the base of the spanner.

The second portion 8 of the base 5 is flat or substantially flat, as shown in particular in FIG. 13.

The second portion 8 of the base 5 comprises a widening, defining a step 12 for the abutment of the hand of the user when holding the handle portion 11.

A corresponding step 12A is also provided along the corresponding edge of the stationary jaw 2.

The base 5 and the stationary jaw 2 comprise respective first holes 13 and second holes 14.

The first holes 13 and second holes 14 are correspondently coaxially arranged when the stationary jaw 2 and the base 5 are fastened together.

In the first holes 13 and second holes 14 are engaged suitable connecting means 15, which fasten the stationary jaw 2 to the base 5.

For example, the connecting means 15 are constituted by rivets, or other equivalent means.

For example, in other embodiments of the invention the connecting means 15 may be constituted by screws, or by welded portions.

In the embodiment of the spanner 1 shown in the attached figures, four first and second holes 13,14 are provided, distributed along the stationary jaw 2 and the base 5.

Of course, the number of first and second holes 13,14 may be different, with reference to specific design requirements.

More in detail, the adjustable coupling means 4 comprise a first rack 16.

The first rack 16 is provided along a first edge 17 of the stationary jaw 2.

The first edge 17 of the first rack 16 is provided on the same side of the operative end portion 2A of the stationary jaw 2.

The adjustable coupling means 4 further comprise a second rack 18.

The second rack 18 is provided along a second edge 19 of the movable jaw 3.

The second edge 19 of the second rack 18 is provided on the opposite side with respect to the operative end portion 3A of the movable jaw 3.

The second rack 18 is selectively mateable with the first rack 16, as better described hereafter, in order to allow the user to displace the movable jaw 3 in the desired position with respect to the stationary jaw 2.

The first rack 16 and the second rack 18 have respective teeth 20,21 having trapezoidal shape, as shown in FIGS. 9,12.

As a non limiting example, the teeth 20 of the first rack 16—provided in the stationary jaw 2—have a pitch P1 of 1 mm, a height H1 of 0.9 mm and inclination angle $\alpha$1 of 38°; the teeth 21 of the second rack 18—provided in the movable jaw 3—have a pitch P2 of 1 mm, a height H2 of 0.7 mm and inclination angle $\alpha$2 of 38°.

The above-cited dimensional parameters of the teeth 20,21 may be varied in accordance with specific design requirements, with no limitations.

The thickness of the stationary jaw 2, movable jaw 3 and base 5 is, as a non-limiting example, comprised between 2 mm and 2.5 mm.

More preferably, such thickness is 2.3 mm.

Therefore, the overall thickness of the adjustable spanner 1 according to the invention is comprised between 4 and 5 mm, and more preferably it is 4.6 mm. The adjustable coupling means 4 further comprise fastening means 22.

Figure 2:
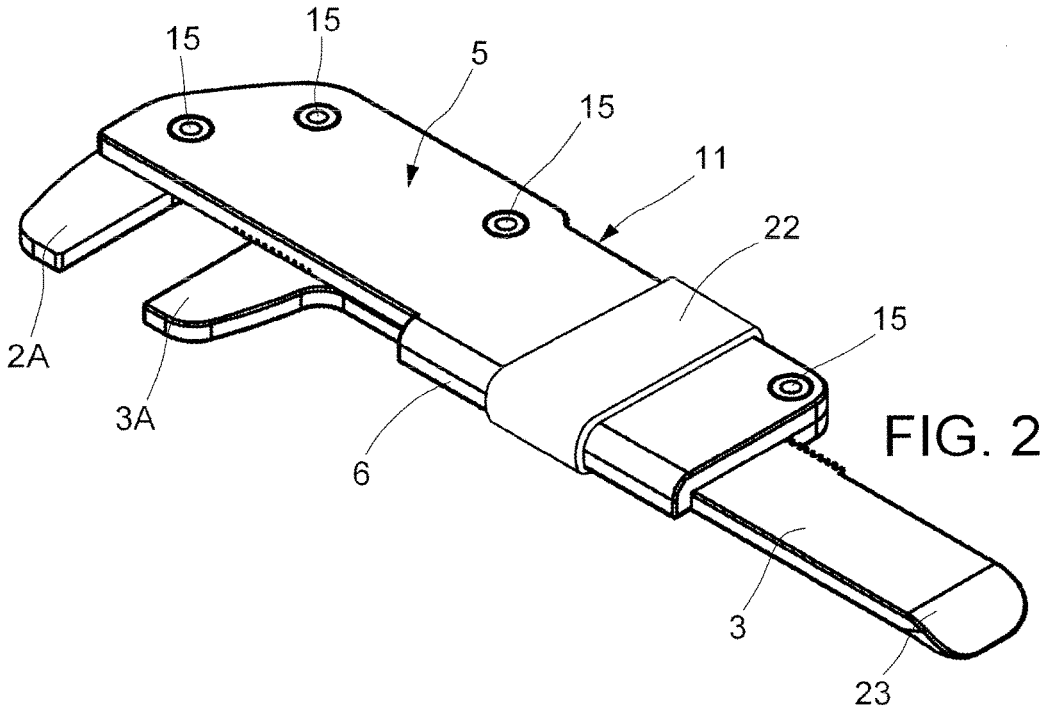
FIG. 2 is an isometric top view of the spanner.
Figure 3:
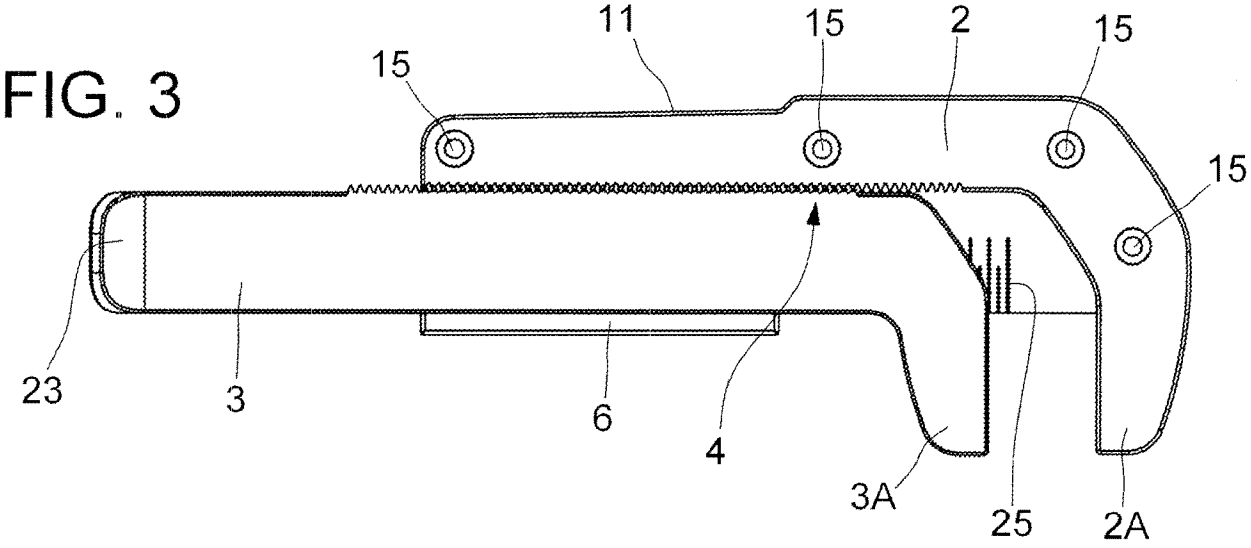
FIG. 3 is a bottom view of the spanner.

As shown for example in FIGS. 1 and 2, the fastening means 22 hold together the stationary jaw 2, the base 5 and the movable jaw 3 in the desired position.

As a non-limiting example, the fastening means 22 may comprise a belt, or an elastic band, or an elastic ring, or other equivalent fastening elements.

In an embodiment of the invention, the fastening means 22 comprise an aluminium sleeve.

In other embodiments of the invention, the fastening means 22 may comprise a sleeve made of any other suitable material.

According to a further aspect of the present invention, the movable jaw 2 of the adjustable spanner 1 comprises a tire lever extremity 23.

The tire lever extremity 23 is provided at the end portion of the movable jaw 3.

Figure 4:
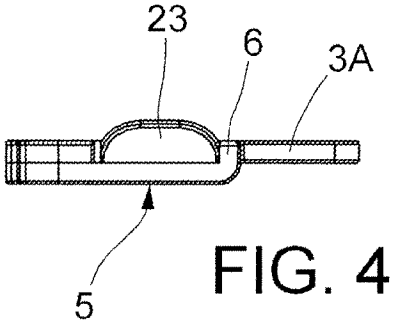
FIG. 4 is a front view of the spanner.
Figure 6:
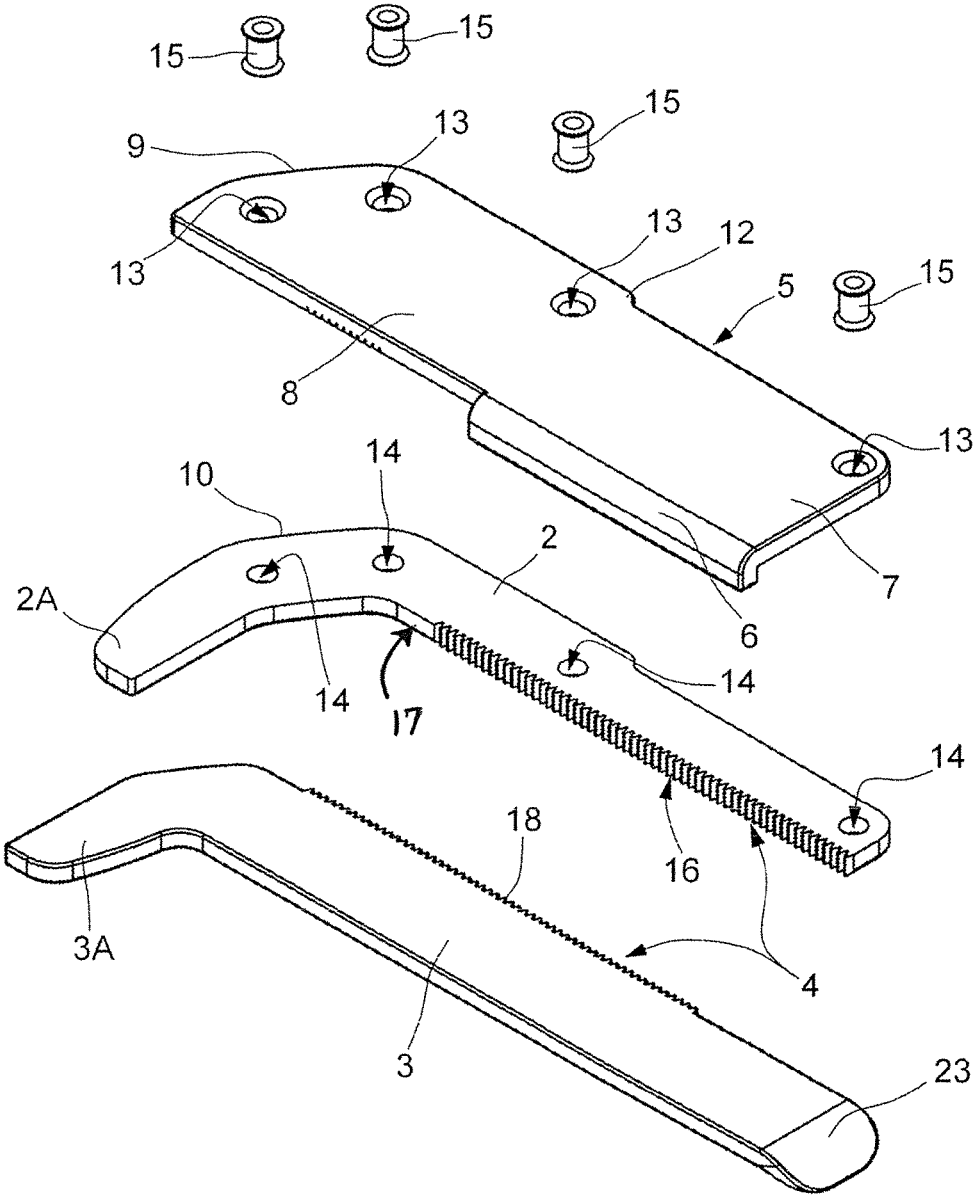
FIG. 6 is an isometric exploded view of the spanner.

The tire lever extremity 23, in a per se known way, is slightly bent, as shown for example in FIGS. 4,5.

The tire lever extremity 23 may be covered with at least a layer of soft material, suitable to come into contact with the surface of the bicycle rim without scratching or denting it.

For example, such soft material could be rubber, a polymeric material, leather, or any other suitable material.

The base 5 of the adjustable spanner 1 comprises, on its internal surface 24, a millimeter scale 25 indicating the actual width of the spanner, in order to allow the user to precisely fit it to the width of the object to be engaged.

The main components of the adjustable spanner 1 according to the invention—the stationary jaw 2, the movable jaw 3, the base 5—can be realized preferably by a stamping process, which is fast and relatively inexpensive.

The components of many adjustable spanners of the known kind are, on the contrary, commonly realized by forging, extensive machining, or other expensive processes.

Figure 16:
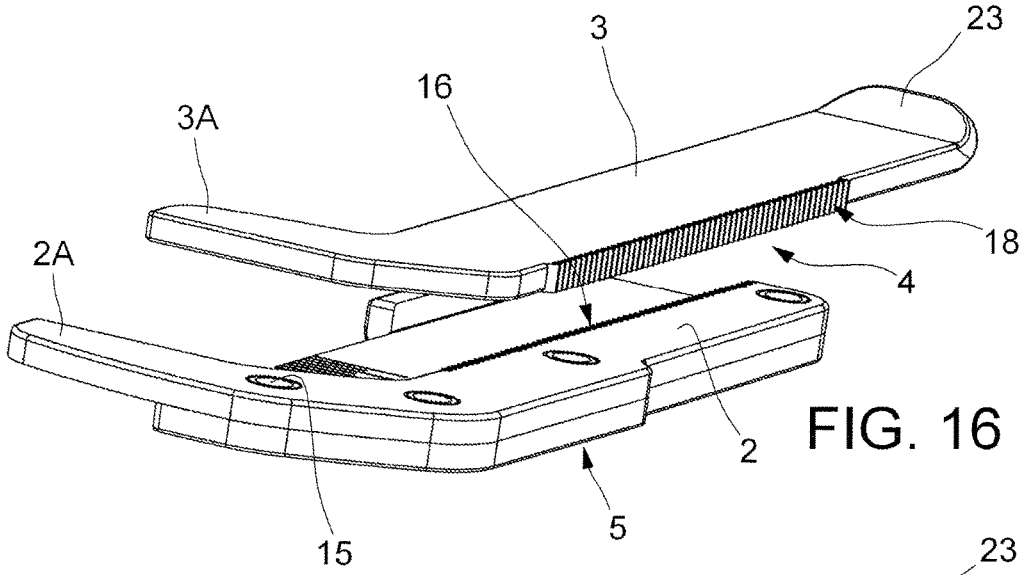
FIG. 16 is a further isometric and partially exploded view of the spanner.

In use, the width of the spanner 1 can be easily adjusted by removing the fastening means 22, and then by removing the movable jaw 3, as shown for example in FIG. 16.

The user then inserts the movable jaw 3 in the desired position, with respect to the stationary jaw 2, corresponding to the desired width of the spanner, in particular mating the teeth 21 of the second rack 18 with the teeth 20 of the first rack 16, as shown in FIG. 17.

Afterwards, the user puts the fastening means 22 back around the stationary jaw 2, the movable jaw 3 and the base 5.

Figure 18:
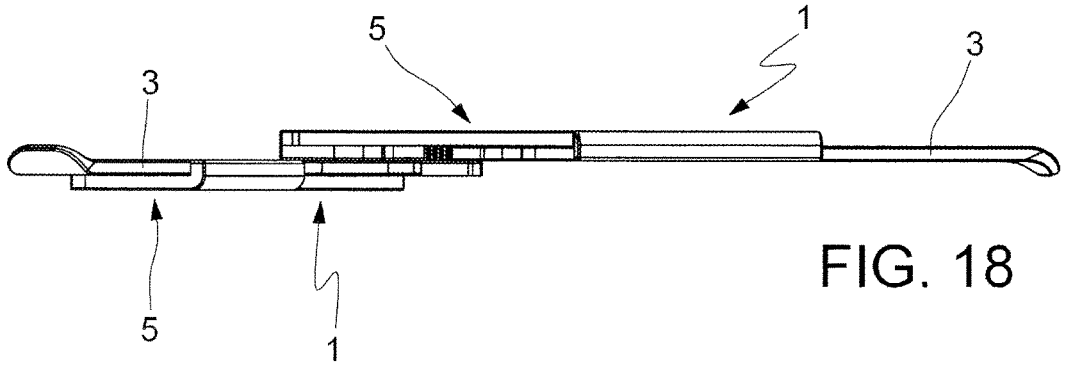
FIG. 18 is a side view of two identical spanners according to the invention juxtaposed in a certain application.

The adjustable spanner 1 is then ready to be employed by the user, which is able to engage the desired object between the operative end portions 2A,3A. FIG. 18 shows a side view of two identical adjustable spanners 1 according to the invention juxtaposed in a certain application.

This figure clearly shows the extremely reduced thickness of the two adjustable spanners 1 when juxtaposed, which can be very helpful in certain applications where the object to be engaged are very close to each other.

Figure 19:
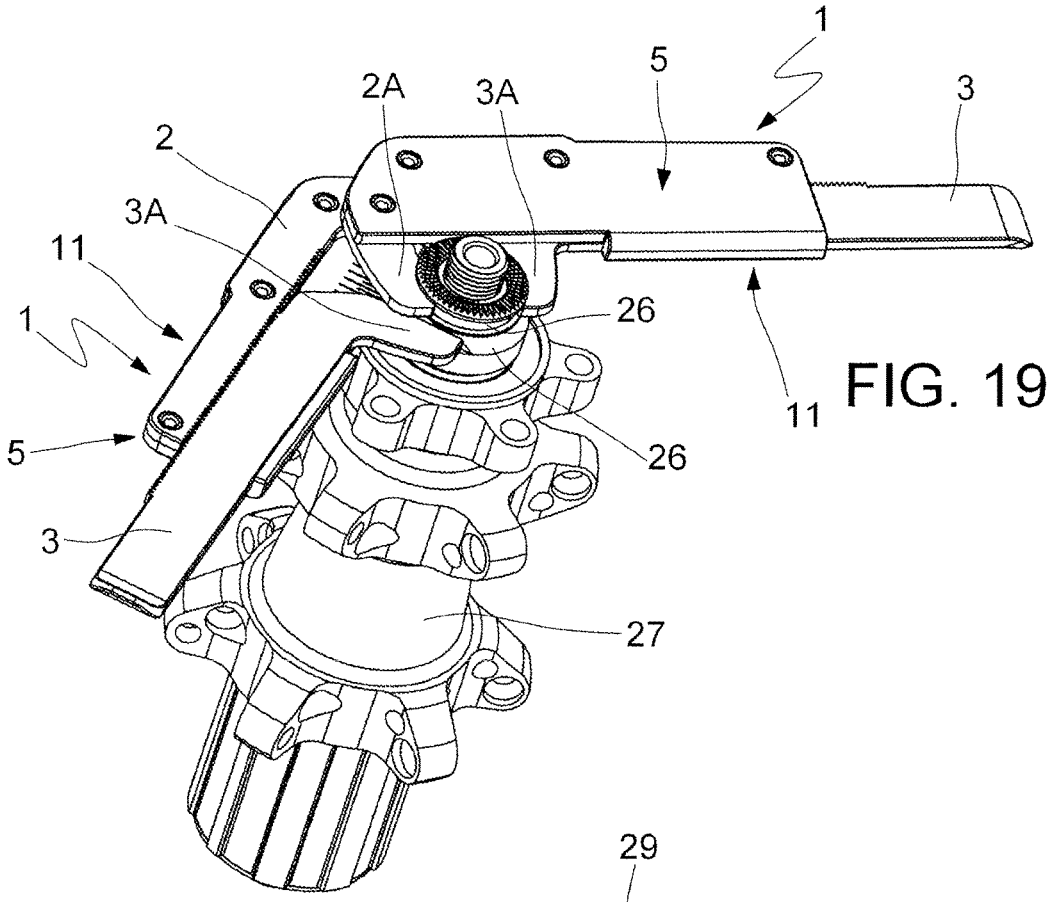
FIG. 19 is an isometric view of two identical spanners according to the invention adjusting the nuts of a bicycle hub.

An example of such an application is shown in FIG. 19, which refers to a common adjustment operation of the nuts 26 of a hub 27 of a bicycle wheel.

Two adjustable spanners 1 according to the invention are employed at the same time, and they engage two respective different nuts 26 of the hub 27.

In this kind of application—and in other similar applications—the nuts 26 are normally arranged very close to each other, in order to reduce the overall encumbrance of the hub 27.

In such an application the adjustment operations would be very difficult and uncomfortable when performed with traditional adjustable spanners 1, which are normally thicker and heavier.

Figure 20:
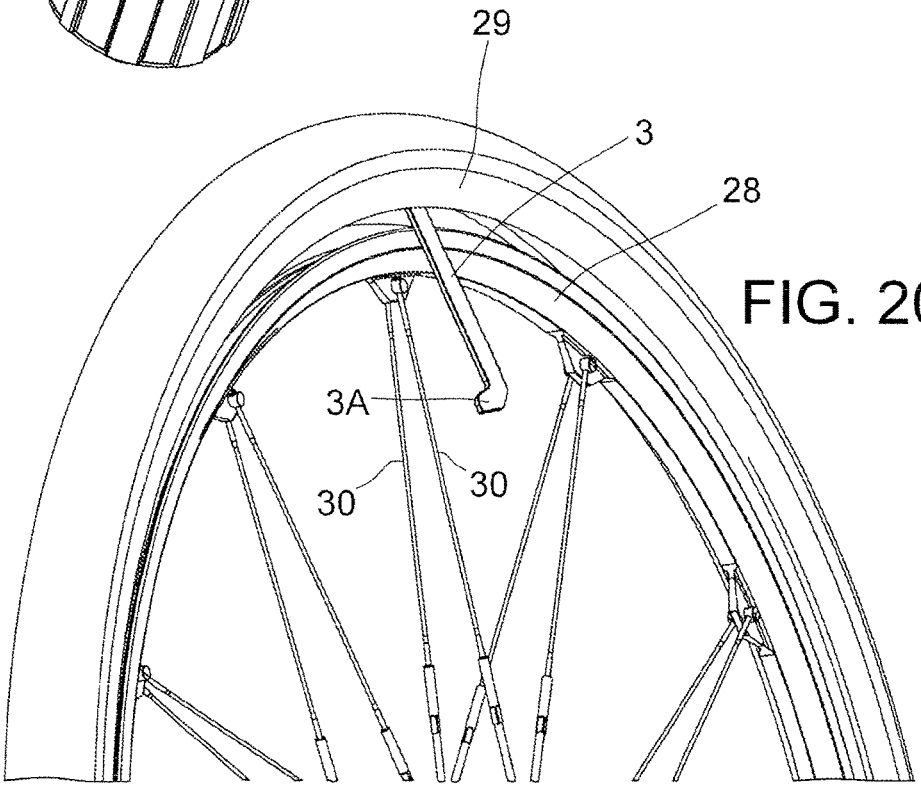
FIG. 20 is an isometric view of the movable jaw of the spanner according to the invention used as a tire lever in a bicycle wheel.

Another useful application of the adjustable spanner 1 according to the present invention is shown in FIG. 20.

This figure shows the movable jaw 3 employed as tire lever.

The tire lever extremity 23 provided at the end portion of the movable jaw 3 can advantageously be inserted between the bicycle wheel rim 28 and the tire 29, in order to remove the latter.

The operative end portion 3A of the movable jaw 3 can be hooked around one or more spokes 30 of the rim 28 to hold the tire 29 away from the rim 28, especially when using two or more tire levers.

It can be seen that the invention reaches the proposed purposes.

The adjustable spanner 1 according to the present invention has a thickness which substantially corresponds to the overall thickness of just two traditional fixed spanners, for example an overall thickness of 4.6 mm.

This feature allows the user to employ the adjustable spanner 1 even in applications with reduced accessibility, for example the application shown in FIG. 19.

Furthermore, this feature allows the user to comfortably carry the adjustable spanner 1, thanks to its reduced encumbrance and weight.

The adjustable spanner 1 according to the invention is also very simple and practical to use: the desired adjustments can be performed very quickly and effectively.

The adjustable spanner 1 according to the invention is very simple and cheap to manufacture, thanks to the possibility to realize all the main components by a stamping process.

The present invention has been described according to preferred embodiments, but equivalent variants can be devised without departing from the scope of protection offered by the following claims.

The invention claimed is:

1. An adjustable spanner, comprising:

an outer stationary jaw;

an inner movable jaw, configured to be coupled to said outer stationary jaw in closed and open positions, wherein the open positions comprise a plurality of different open positions in order to engage objects of different sizes, said outer stationary jaw and said inner movable jaw being both substantially flat and L-shaped in a top view, said outer stationary jaw and said inner movable jaw comprising respective operative end portions for engaging objects between them, wherein a space is formed between the respective operative end portions when the inner movable jaw is in an open position;

a substantially flat base comprising a first portion and a second portion, wherein said base is fixed to said outer stationary jaw and comprises a folded portion laterally embracing said inner movable jaw wherein said outer stationary jaw and said inner movable jaw lay on the same plane;

a first rack, provided along a first edge of said outer stationary jaw, and a second rack, provided along a second edge of said inner movable jaw, and selectively mateable with said first rack, wherein the first edge of the first rack is provided on a same side of the operative end portion of the outer stationary jaw, wherein the second edge of the second rack is provided on an opposite side with respect to the operative end portion of the inner movable jaw, wherein said inner movable jaw is completely removable from said base and from said outer stationary jaw in order to adjust the width of the spanner, wherein said folded portion of said base is provided along a lateral edge of said first portion, wherein a handle portion corresponds to said first portion of said base, and wherein said base comprises a perimetric profile which exactly mates the external edge of said outer stationary jaw, thus defining said handle portion of the spanner, wherein said base and said outer stationary jaw comprise respective first holes and second holes which are correspondingly coaxially arranged and through which rivets are engaged fastening the base to the outer stationary jaw so that the base extends across the space formed between the respective operative end portions when the inner movable jaw is in an open position, and wherein said base comprises, on its internal surface a millimeter scale indicating the actual width of the spanner, wherein the millimeter scale is provided in the space between the respective operative end portions.

2. The adjustable spanner according to claim 1, wherein the first portion of the base has a substantially L shaped cross section.

3. The adjustable spanner according to claim 1, wherein said second portion is flat and comprises a widening defining a step for the abutment of the hand of the user.

4. The adjustable spanner according to claim 1, in which said inner movable jaw comprises a tire lever extremity provided at its end portion.

5. The adjustable spanner according to claim 1, wherein said first rack and said second rack have respective teeth having trapezoidal shape.

6. The adjustable spanner according to claim 1, comprising a belt or an elastic band, or a sleeve made of any other suitable material, holding together said outer stationary jaw, said base and said inner movable jaw in the desired position.

7. The adjustable spanner according to claim 6, comprising an aluminum sleeve or a sleeve made of any other suitable material.

8. The adjustable spanner according to claim 1, wherein the thickness of said outer stationary jaw, inner movable jaw and base is comprised between 2 mm and 2.5 mm.

9. The adjustable spanner of claim 1, wherein the millimeter scale is visible only when the inner movable jaw is in the open position.

* * * * *